United States Patent [19]

Bednar

[11] Patent Number: 4,506,762

[45] Date of Patent: Mar. 26, 1985

[54] UTILITY POLE AND TREE CLIMBING AID

[76] Inventor: Ernest G. Bednar, 2905 Highland Ct., Arcata, Calif. 95521

[21] Appl. No.: 461,499

[22] Filed: Mar. 24, 1983

[51] Int. Cl.[3] ..... A63B 27/00

[52] U.S. Cl. ..... 182/221; 182/9

[58] Field of Search ..... 182/221, 9, 8

[56] References Cited

U.S. PATENT DOCUMENTS

| | | | |
|---|---|---|---|
| 237,275 | 2/1881 | Hill | 182/221 |
| 938,905 | 11/1909 | Speerstra | 182/221 |
| 1,727,237 | 9/1929 | Katz | 182/221 |
| 2,391,810 | 12/1945 | Webber | 182/221 |
| 2,428,075 | 9/1947 | Hare | 182/134 |
| 2,604,250 | 7/1952 | Trimble | 182/221 |
| 3,867,998 | 2/1975 | Joseph | 182/221 |
| 4,153,139 | 5/1979 | Houch | 182/221 |

*Primary Examiner*—Reinaldo P. Machado

[57] ABSTRACT

In the tree and utility pole climbing process the use of climbing spurs and safety belts is quite common among other methods. The inherent weight of the climbing spurs coupled with the act of extracting the spur from the tree or pole creates an unusual strain on the knee joints of the climber. The improvement comprising a harness composed of a pair of cup shaped knee pads which are adjustably attached to the shin guard of the climbing spurs and thence by means of adjustable straps and swivel harness snaps to 'D' rings on the safety belt surrounding the climber's waist, thereby minimizing the unnatural strain on the knee joints of the user.

2 Claims, 3 Drawing Figures

UTILITY POLE AND TREE CLIMBING AID

BACKGROUND OF THE INVENTION

This invention relates to utility pole and tree climbers. Tree and pole climbing aids have been used since the late 1800's. Since that time several patents have been granted for variations of climbing spurs which had as one of their objectives the reduction of weight of the units. The combination of inherent weight of the climbing spurs and the added pull on the knee joint necessitated during the extraction of the gaff or spur from the tree or pole adds much to the discomfort of the individual doing the climbing.

U.S. Pat. No. 237,275 granted Feb. 6, 1881 was an early version of a pole climbing aid. U.S. Pat. No. 938,905 dated Nov. 1909 attempted to achieve lightness but it failed to protect the ankle of the wearer. Later patents such as U.S. Pat. No. 2,391,810 dated Dec. 24, 1945; U.S. Pat. No. 2,604,250 dated July 22, 1952; and U.S. Pat. No. 3,867,998 of Feb. 25, 1975 each incorporated a vertical bar strapped to the foreleg of the wearer. These climbers use a short solid gaff or spur to engage the pole or tree being climbed.

U.S. Pat. No. 4,153,139 dated May 8, 1979, a Non Adjustable Climber, achieves lightness by incorporating a pressed steel vertical bar and a hollow gaff or spur which uses a cutting action to penetrate the tree or pole as distinguished from the expansion forces in the penetration by the solid spur or gaff. The primary stated purpose being the reduction of overall weight of the climbing spurs as well as the effort required to insert and extract the gaff from the tree or pole and thereby reducing the strain and fatigue of the wearer.

U.S. Pat. No. 2,428,075 filed May 10, 1946 is a pole climbing harness which uses thigh band and foot harness each incorporating a rope with a clove hitch for traversing a vertical pole.

SUMMARY OF THE INVENTION

The present invention uses an entirely new approach for releiving the strain on the knee joints of the wearer by transferring the pressure to the top of the knee by means of the padded leather cup and thence to the 'D' ring on the standard climber's safety belt.

This invention is intended to be attached to the upper portion of existing standard tree or pole climbing spurs by various methods dependent upon the configurations incorporated by the particular manufacturer to strap the iron around the calf of the foreleg of the climber. An adjustment method would be provided to accomodate the wearers of differing anthropometric proportions to assure the comfortable placement of the padded leather covering over the knee joint of the wearer.

The strap fastened to the top of the knee pad and incorporating a swivel snap at its upper end which connects to the 'D' ring on the climber's safety belt is also adjustable.

In use, when the knee is bent preparatory to extraction of the gaff or spur from the tree or pole, the strain is immediately born by the top of the knee and the safety belt around the wearer's waist thus eliminating the previous unnatural strain on the knee joint of the leg.

The climbing aid provides the additional benefits of helping to support the climbing spurs when approaching the tree or pole as well as when walking from one pole to the next. The padded leather cups also protect the knees from abrasions while the climber is performing his work on the tree or pole.

It is intended that the climbing aids be permitted to remain strapped to the top of the climbing spurs and therefore requiring the simple snapping of the swivel harness snap to the 'D' rings on the climber's safety belt once the climbing aids have been adjusted to his particular proportions.

BRIEF DESCRIPTION OF THE DRAWINGS

The accompanying drawings illustrate the best mode presently contemplated for carrying out the invention.

DESCRIPTION OF THE PREFERRED EMBODIMENT

Figures 1, 2, 3:
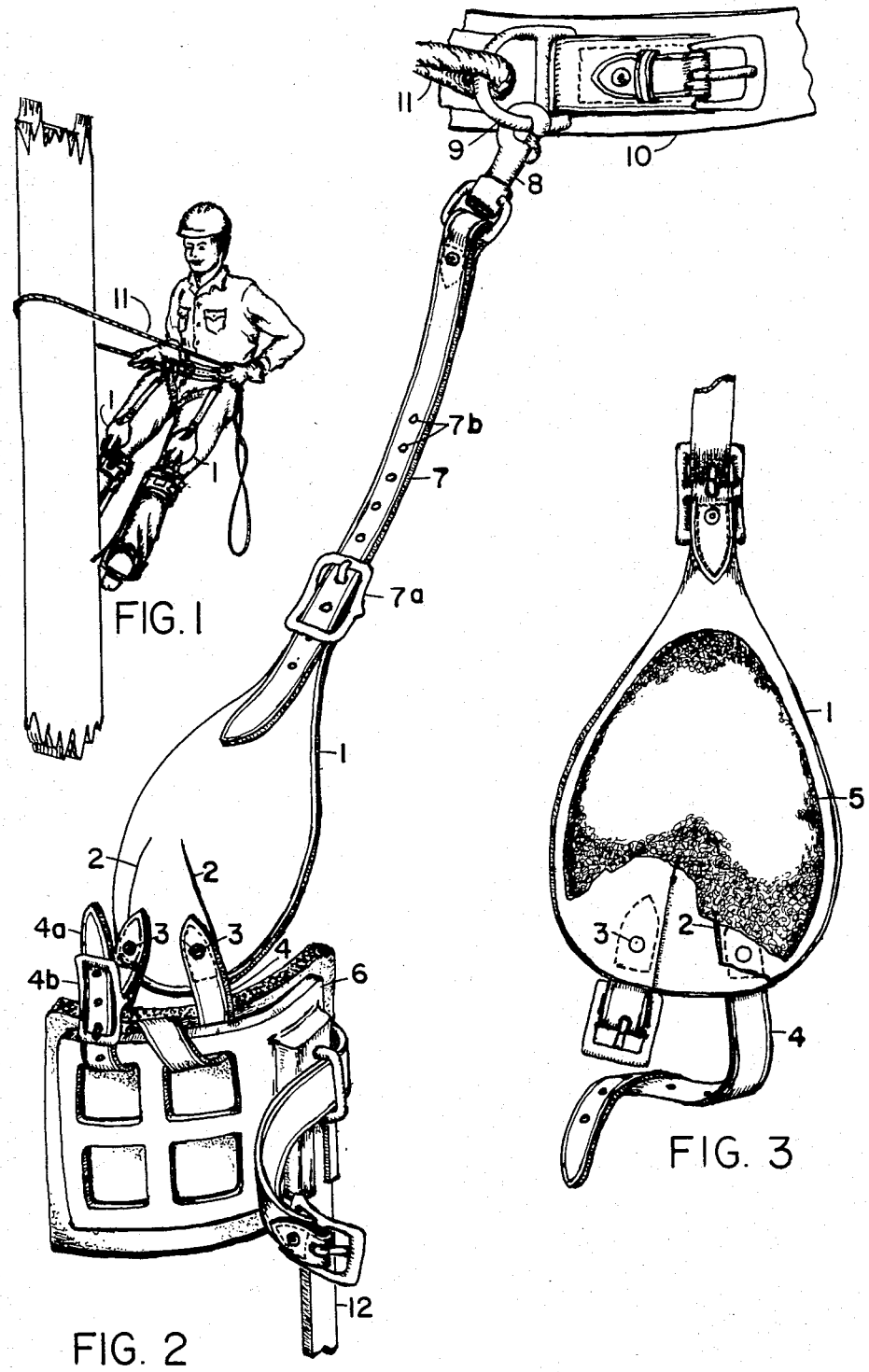
FIG. 1 is a perspective view illustrating the climbing aids in use by the climber.
FIG. 2 is an enlarged illustration of a climbing aid which indicates one method of attachment to the top of a standard climbing spur as well as the method of attachment to the 'D' ring on the climber's safety belt.
FIG. 3 is a view of the concave back side of the climbing aid knee pad.

Referring to the drawings in detail and in particular to FIG. 2 the leather knee pad 1 is fastened to the top of the climber's spur 12 by strap 4 which is laced through the aluminum shin guard 6 at the top of the standard climbing spur. The knee pad 1 is formed into a cup shape by slitting the leather in two places as shown at 2 and 2*a* and overlapping the material. The rivets 3 which are used to fasten the overlapped leather into a cup shape serve the secondary function of providing a means to attach the strap 4 and buckle 4*a*. The material could also be stitched to strengthen the overlapped joint and the straps may also be stitched in order to reinforce the connection. This strap 4 is then looped through the aluminum shin guard 6 of a standard climbing spur. The strap 4 has several centrally aligned and uniformily spaced holes 4*b* to permit the adjustment of the knee pad 1 to the most comfortable position on the climber's knee.

Refering to FIG. 3 the sponge rubber pad 5 which is glued to the underside of the knee pad 1 provides a cushion to make the contact between the knee pad 1 and the climber's knee more comfortable as well as providing a protection for the knee against abrasion. Other resiliant type materials such as sheep skin could also be used to cushion the cup shaped knee pad and the material could also be attached by stitching to strengthen the bond.

Refering again to FIG. 2 the knee pad 1 has a buckle 7*a* attached to its upper-most portion which engages the strap 7. A series of uniformly spaced holes 7*b* in the strap 7 provide adjustment for climbers of varying anthropometric proportions. At the top end of this strap 7 is attached a swivel harness snap 8 by means of a rivet and/or stitching which provides the means to easily hook the strap 7 to the 'D' ring 9 which is in turn attached to the standard safety belt 10. These 'D' rings are normally a part of a standard climber's safety belt 10 to which the safety climbing rope 11 is usually attached.

FIG. 1 illustrates a pair of climbing aids being used by a utility pole climber and indicates the location of the concave padded leather cups 1 over the knees during the performance of his duties.

Other appropriate materials could be used to fabricate any or all of the indicated parts of the climbing aids such as man made materials.

Having thus described the preferred embodiment of the invention it should be understood that numerous structural modifications and adaptations may be resorted to without departing from the spirit of the invention.

What I claim is:

1. A pair of standard tree and utility pole climbing spurs are usually composed of vertical metal bars positioned on the inside of the lower portion of the legs of the climber starting just below the knees and extending downward below the insteps and thence curving under the shoes and a short distance up the outside of said shoes at which point straps are attached which are buckled around the ankles; the upper portion of the bars usually have a padded metal portions attached to them at right angles which curve around the front of the shins and are attached to the legs at this point by straps which encircle the legs just below the knees; strap spurs are attached to the bars just outside the insteps above the point at which the bars curve under the shoes, to engage the tree or pole in the climbing process; the extraction of which, coupled with the inherent weight of the climbing spurs tend to create an undue strain on the knee joints of the climber; the climber normally also wears a safety climbing belt around his waist with a strap or rope which is attached to 'D' rings on the belt and encircles the pole being climbed; the improvement comprising a harness composed of a pair of padded cup shaped knee pads attached to the shin guards at the upper portion of the climbing spurs by adjustable straps which position the knee pads over the knee caps; attached to the upper portion of said cup shaped knee pads are adjustable straps with swivel harness snaps which are in turn attached to the 'D' rings of the safety belt, thereby transmitting the pulling force, necessary for lifting the heavy spurs and the extraction of said spur points from the pole, to the top of the knee caps and thence to said safety belt around the waist of the climber thereby relieving the unnatural strain on the knee joints of the climber.

2. A pair of utility pole or tree climbing aids consisting of two generally cup shaped padded leather knee pads with adjustable leather straps attached to their lower portions which provides an adjustable means for positioning said pads over the knee caps of the climber when attached to the upper portion of standard utility pole and tree climbing spurs, and also with liniarly adjustable leather straps attached to the upper portion of said leather knee pads which terminate in swivel harness snaps at their upper ends and which are intended to be snapped onto the 'D' rings of standard safety belts normally worn around the waist of the utility pole or tree climber; thereby minimizing the excessive strain on the knee joints of the climber created by the combination of the inherent weight of the climbing spurs and the force necessary to extract said spur from said utility pole or tree during the climbing process, thus adding to the climber's comfort and safety.

* * * * *